US006918474B2

(12) United States Patent
Nykoluk

(10) Patent No.: US 6,918,474 B2
(45) Date of Patent: Jul. 19, 2005

(54) TOWABLE WHEELED-BACKPACK

(75) Inventor: Cory O. Nykoluk, Ballwin, MO (US)

(73) Assignee: TRG Assessories, L.L.C., St. Louis, MO (US)

( * ) Notice: Subject to any disclaimer, the term of this patent is extended or adjusted under 35 U.S.C. 154(b) by 0 days.

(21) Appl. No.: 10/103,033

(22) Filed: Mar. 21, 2002

(65) Prior Publication Data

US 2002/0096410 A1 Jul. 25, 2002

Related U.S. Application Data

(63) Continuation of application No. 09/604,995, filed on Jun. 28, 2000.

(51) Int. Cl.[7] ..... A45C 13/26
(52) U.S. Cl. ..... 190/115; 190/18 A; 16/113.1; 224/153
(58) Field of Search ..... 190/115, 18 A; 16/113.1

(56) References Cited

U.S. PATENT DOCUMENTS

| | | | | |
|---|---|---|---|---|
| 3,496,795 | A | | 2/1970 | Dinnendahl |
| 3,606,372 | A | | 9/1971 | Browning |
| 3,799,568 | A | | 3/1974 | Hager |
| 4,037,858 | A | * | 7/1977 | Adams ..... 280/652 |
| 4,368,835 | A | | 1/1983 | Murphy |
| 4,538,709 | A | | 9/1985 | Williams et al. |
| D282,787 | S | * | 2/1986 | Nichols ..... D34/25 |
| 4,616,379 | A | | 10/1986 | Lio |
| 5,249,438 | A | * | 10/1993 | Rhaney et al. ..... 62/457.7 |
| 5,323,887 | A | | 6/1994 | Scicluna et al. |
| 5,339,934 | A | | 8/1994 | Liang |
| 5,429,317 | A | | 7/1995 | Yamaguchi |
| 5,464,080 | A | | 11/1995 | Liang |
| 5,464,081 | A | | 11/1995 | Zwanzig |
| 5,469,945 | A | | 11/1995 | Jserng |
| 5,491,872 | A | | 2/1996 | Tserng |
| 5,497,865 | A | | 3/1996 | Yun-Pi |
| 5,547,053 | A | | 8/1996 | Liang |
| 5,564,538 | A | | 10/1996 | Sadow |
| 5,615,757 | A | | 4/1997 | Chen |
| 5,630,521 | A | | 5/1997 | Waddell et al. |
| 5,647,095 | A | | 7/1997 | Takimoto |
| 5,689,854 | A | | 11/1997 | Wang |
| D387,198 | S | | 12/1997 | Lehmann et al. |
| 5,706,921 | A | | 1/1998 | Wang |
| 5,713,441 | A | | 2/1998 | Chen |
| 5,749,503 | A | | 5/1998 | Wulf et al. |
| 5,769,194 | A | | 6/1998 | Chang |
| 5,865,281 | A | | 2/1999 | Wang |
| 5,868,406 | A | | 2/1999 | Sadow |
| 5,884,362 | A | | 3/1999 | Tsai |
| 5,890,570 | A | | 4/1999 | Sadow |
| 5,893,495 | A | | 4/1999 | Godshaw et al. |
| 5,901,822 | A | | 5/1999 | Tu |
| 5,908,093 | A | | 6/1999 | Miyoshi |
| 5,943,936 | A | | 8/1999 | Deliman et al. |
| 5,984,154 | A | | 11/1999 | Scicluna |
| 6,009,598 | A | | 1/2000 | Chang |
| 6,041,900 | A | | 3/2000 | Sadow et al. |

(Continued)

*Primary Examiner*—Tri Mai
(74) *Attorney, Agent, or Firm*—Armstrong Teasdale LLP

(57) ABSTRACT

A towable, wheeled-backpack includes a towing handle attached to a curved, single-pole, telescoping towing member which retracts into the backpack when not in use. The curvature of the towing member provides support for a backing sheet that is attached to the towing member, and the backing sheet is contoured so that the backpack can be comfortably supported on a wearer's back. A rigid base with wheels is pivotally attached to a bottom end of the towing member. The pivot attachment allows the base and wheels to move independently of the towing member as the bag is worn or as the bag is rolled along the ground.

3 Claims, 3 Drawing Sheets

U.S. PATENT DOCUMENTS

| | | | |
|---|---|---|---|
| 6,059,301 | A | 5/2000 | Skarnulis |
| 6,129,365 | A | 10/2000 | Sadow |
| 6,179,101 | B1 | 1/2001 | Lin |
| 6,179,176 | B1 | 1/2001 | Saggese et al. |
| 6,193,033 | B1 | 2/2001 | Sadow et al. |
| 6,227,339 | B1 | 5/2001 | Bogert |
| 6,237,734 | B1 | 5/2001 | Chen |
| 6,279,706 | B1 | 8/2001 | Mao |
| 6,298,964 | B1 | 10/2001 | Sadow |
| 6,434,790 | B1 | 8/2002 | Chen |
| 6,591,951 | B1 | 7/2003 | Chen |

* cited by examiner

TOWABLE WHEELED-BACKPACK

This application is a continuation of the copending U.S. patent application assigned Ser. No. 09/604,995 filed on Jun. 28, 2000, pending in the Patent office.

BACKGROUND OF THE INVENTION

1. Field of the Invention

This invention pertains to the field of backpacks of the type that can be worn on a person's back or over a person's shoulder. More particularly, this invention pertains to a wheeled-backpack having a unique, non-rigid or flexible connection between a rigid wheeled base of the backpack and a supporting backing sheet of the backpack that rests against a person's back when worn. The flexible connection allows the base and backing sheet to move relative to each other as the backpack wearer's upper body moves, enabling the backpack to be more comfortably worn. Additionally, a unique curved extendable towing member is utilized that follows the curvature of the backpack wearer's back to further enhance the comfort of wearing the backpack.

2. Background of the Invention

It is common for many varieties of baggage to be equipped with wheels that enable the baggage to be towed by persons when traveling. A typical towable piece of baggage generally includes a pair of wheels and an extendable towing member connected to the piece of baggage.

A typical wheeled-suitcase, for example, has wheels that are only a few inches in diameter. The wheels are usually mounted spaced apart on an edge of the suitcase where they can support the suitcase above the ground when the suitcase is tilted and towed. Although some suitcase have retractable wheels and some have casters, most suitcases have wheels that are fixed in a single orientation relative to an edge of the suitcase.

It is also common for the wheels of such towable baggage to be mounted to a rigid base of the piece of baggage. The rigid base has sufficient stiffness to support the wheels in their fixed orientation and to support the weight of the piece of baggage and its contents when being towed. In the case of a rigid wheeled-suitcase having a shell made of plastic, aluminum, or other generally stiff material, the rigid base is often merely a portion of the suitcase exterior. Conversely, baggage made mostly of canvas, nylon, leather, or other flexible materials generally utilize some form of stiffening frame or rigid base adjacent the exterior of the baggage for supporting the weight and holding the wheels in their fixed orientation.

As mentioned above, a wheeled pieced of baggage also commonly includes some form of towing member with a towing handle that is extendable from the piece of baggage. Extension of the towing member allows the piece of baggage to be pulled behind a person without coming into contact with the person's legs and feet as the piece of baggage is being towed.

In many cases, a wheeled piece of baggage has an extendable towing member comprised of a pair of parallel telescoping poles bridged by the towing handle. The poles slide into separate vertically oriented tubular receptacles rigidly attached to an interior compartment of the piece of the baggage. In such a configuration, the towing member least interferes with the internal compartment of the piece of baggage and is generally not visible from the exterior of the piece of baggage when stowed or retracted. Other types of baggage utilize single-pole telescoping tow members that extend and retract from a single tubular receptacle that is centrally positioned between the wheels of the piece of baggage.

Yet other types of baggage utilize non-telescoping extendable towing members such as bars or poles that are hinged to the piece of baggage. Typically, such pieces of baggage have some form of clasp that holds the towing member against a side of the piece of baggage when the baggage is not being towed and that releases the towing member when desired to allow the towing member to pivot upwardly into an extended position. Such towing members can also usually be locked into a particular extended position.

Providing baggage such as overnight luggage or suitcases with wheels has increased in popularity and their convenience has been appreciated to the extent that recently, wheels have begun being provided on other types of baggage such as backpacks. However, most backpacks have merely been provided with the same type of wheeled towing systems commonly utilized with conventional baggage as described above. Prior art wheeled-backpacks provided with conventional towing systems suffer from disadvantages due to their different design and construction from that of other types of baggage such as suitcases, and due to their commonly being worn on the back of the user unlike other types of baggage.

One such disadvantage is that, unlike suitcases, it is desirable that a backpack be able to flex, especially on the portion of the backpack that rests against a person's back when being worn. This is because, as a person walks, the person's shoulders rotate relative to his or her hips, thereby causing his or her back to twist. Like wheeled-suitcases, conventional wheeled-backpacks typically have an extendable towing member rigidly attached to the base of the backpack. This is because it was generally thought in the art that the towing member must be rigidly attached to the base of the piece of baggage to effectively be used to tilt and tow the piece of baggage along the ground. However, the rigid construction of prior art wheeled-backpacks is disadvantaged in that, as a person walks while wearing such a backpack, portions of the backpack are unable to maintain contact against the person's back and thereby cause discomfort as they intermittently contact the person's back. Additionally, as a wearer climbs stairs or leans to one side such as when reaching down to pick up another item, one of the wearer's shoulders is momentarily closer to the wearer's hips than the other. In this situation, depending upon the particular configuration of the backpack, either the bottom or the top of the backpack will slide from side to side causing additional discomfort. These aspects of prior art wheeled-backpacks cause such backpacks to feel more like strapped on suitcases rather than conventional non-wheeled-backpacks which are soft sided and much more comfortable.

In addition to the disadvantages in comfort, the rigid construction of prior art wheeled-backpacks also suffers from structural disadvantages. Unlike suitcases that typically have a rigid rectangular frame or shell for maintaining the shape of the suitcase which also is used to adequately support the towing member, prior art wheeled-backpacks generally lack such a support. Thus, the towing member of a prior art wheeled-backpack is typically supported by the rigid base of the backpack on which the wheels are mounted. In this configuration, the towing member acts as a leverage arm creating large stresses at the union between the towing member and the base even during normal towing. Additional stresses are generated when the wheels of such a backpack attempt to move independently of the towing member, such as when one wheel encounters an obstruction when the backpack is being towed. In such a situation, one of the wheels typically rides over the obstruction while lifting the other wheel above the ground, thereby causing torsional loading of the towing member. To withstand these loads, the base of the towing member of a typical prior art backpack is made substantially strong and durable, which limits the materials that may used to construct the backpack and which influences the weight of the backpack.

Yet another disadvantage associated with any type of wheeled baggage having a rigid construction is that they are prone to tipping over when being towed around corners. This tendency to tip is due to the towing member functioning as a lever arm which causes a large torque to act upon the baggage when even small forces are applied to the towing handle.

SUMMARY OF THE INVENTION

The towable wheeled backpack of the invention overcomes the disadvantages associated with prior art wheeled-backpacks by providing a towing system uniquely adapted for use with backpacks. The towing system allows a wheeled-backpack to flexibly conform to a person's twisting back when being worn, while still maintaining the structural integrity needed to tow the backpack if desired. Thus, the towing system of the invention greatly improves the comfort of wearing a wheeled-backpack and actually improves the towability of wheeled-backpacks.

In general, the invention comprises several elements in common with prior art wheeled-backpacks such as shoulder straps, a waist strap, wheels, and an extendable towing member. Unlike prior art backpacks however, the preferred embodiment of the invention utilizes novel constructions of the common elements and several additional novel features.

The preferred embodiment of the wheeled-backpack of the invention comprises a pivotal connection between a rigid base portion of the backpack and an extendable towing member upon which an internal supporting backing sheet is attached. The pivotal connection allows the backing sheet to twist relative to the base as a person's shoulders twist relative to his or her hips when the backpack is being worn. This eliminates the discomfort experienced using prior art wheeled-backpacks having a back fixed relative to the base. Additionally, the pivotal connection reduces the torsional forces acting on the towing member by allowing the wheels of the backpack to move relative to the towing member and "step" over obstructions when the backpack is being towed. The pivot connection also reduces unintentional tipping of the backpack due to sudden forces acting on the towing member, thereby improving the towability of the back pack while reducing the size and weight of the towing member.

The wheeled-backpack of the preferred embodiment also utilizes a curved single-pole telescoping towing member. The curvature of the towing member follows the contour of the backing sheet which is curved similar to that of a wearer's back rather than being flat or planar as prior art wheeled-backpacks. Additionally, the curvature of the towing member allows the tow handle to extend upwardly and forward of the backpack where it is in an optimum position for towing the backpack.

While the principal advantages and features of the present invention have been described above, a more complete and thorough understanding of the invention may be attained by referring to the drawings and detailed description of the embodiments which follow.

BRIEF DESCRIPTION OF THE DRAWINGS

Reference characters in the written specification indicate corresponding parts throughout the several views of the drawings.

DETAILED DESCRIPTION OF THE INVENTION

Figure 1:
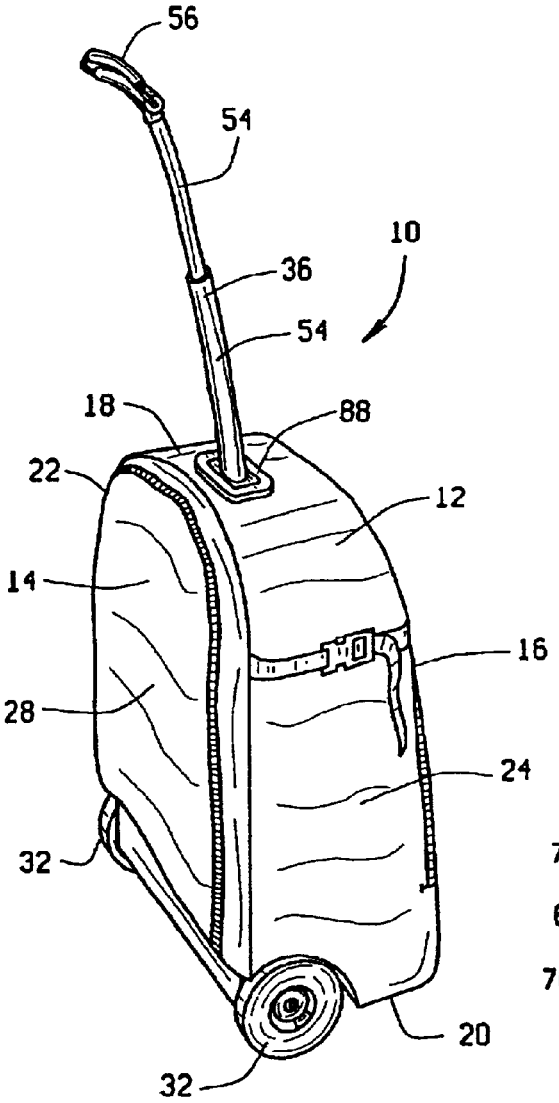
FIG. 1 is an isometric view of the preferred embodiment of the invention showing the backpack with the towing member in a fully extended position.
Figure 4:
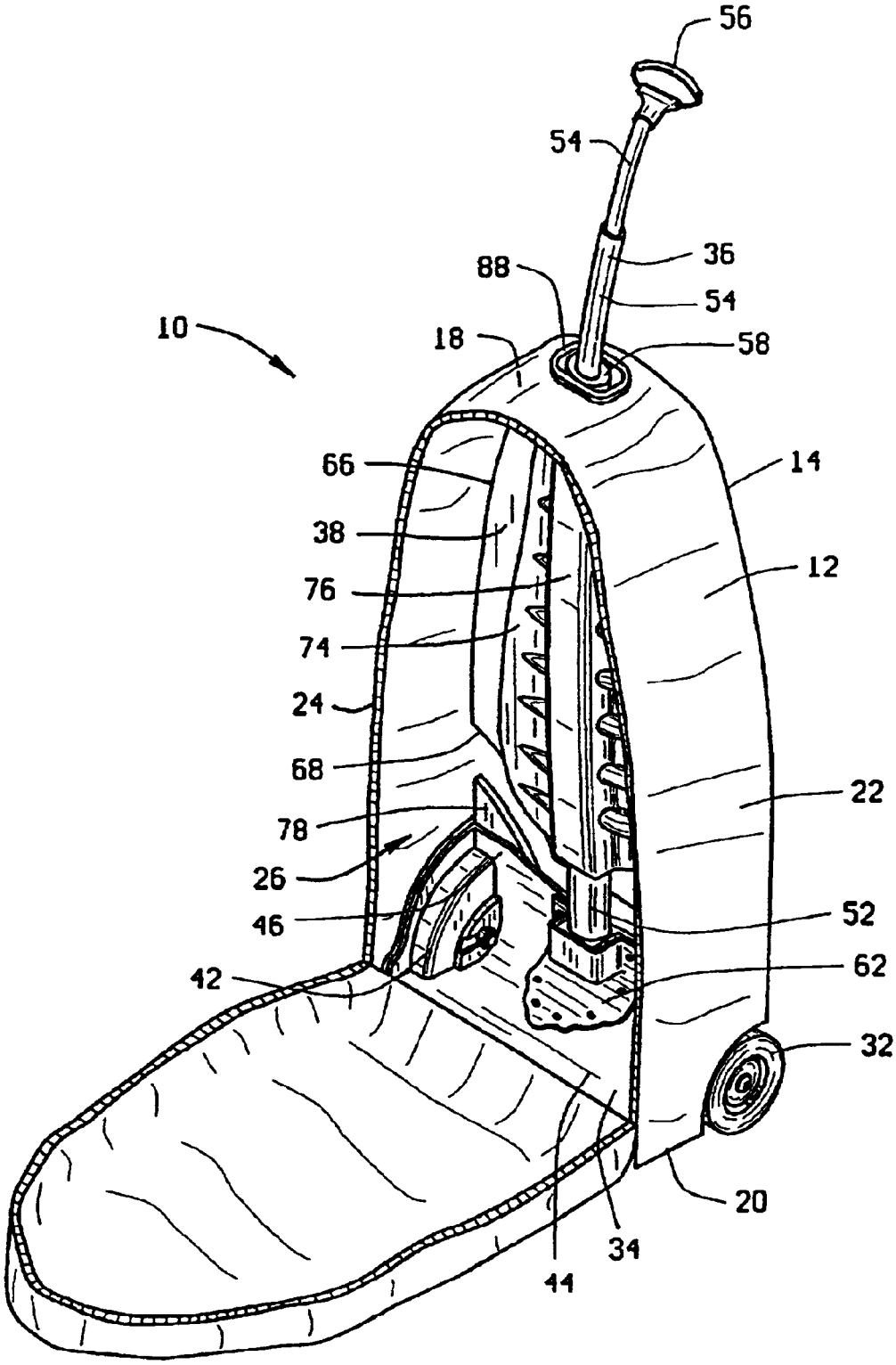
FIG. 4 is an isometric assembly view of the preferred embodiment of the invention showing the placement of the structural components relative to the pack portion of the backpack.

The preferred embodiment of the wheeled-backpack 10 of the invention is shown in FIG. 1 and, like typical backpacks, comprises a pack portion 12 with an opposite front 14 and back 16, opposite top 18 and bottom 20, and opposite left 22 and right 24 sides. The pack portion 12 of the wheeled-backpack 10 is formed of a woven nylon material or other suitable flexible material and has at least one accessible storage compartment 26, as shown in FIG. 4, for storing various items to be carried within the backpack. Additionally, like prior art backpacks in general, the wheeled-backpack has a pair of shoulder straps (not shown) and, optionally, a waist strap (not shown) for supporting the wheeled-backpack on a wearer's back. When not being worn, a closeable shroud 28 on the front 14 of the pack portion 12 conceals the shoulder straps and waist strap therebehind, as shown in FIG. 1, so that the straps will not drag along the ground or become snagged on other items when the wheeled-backpack 10 is being towed.

Figure 3:
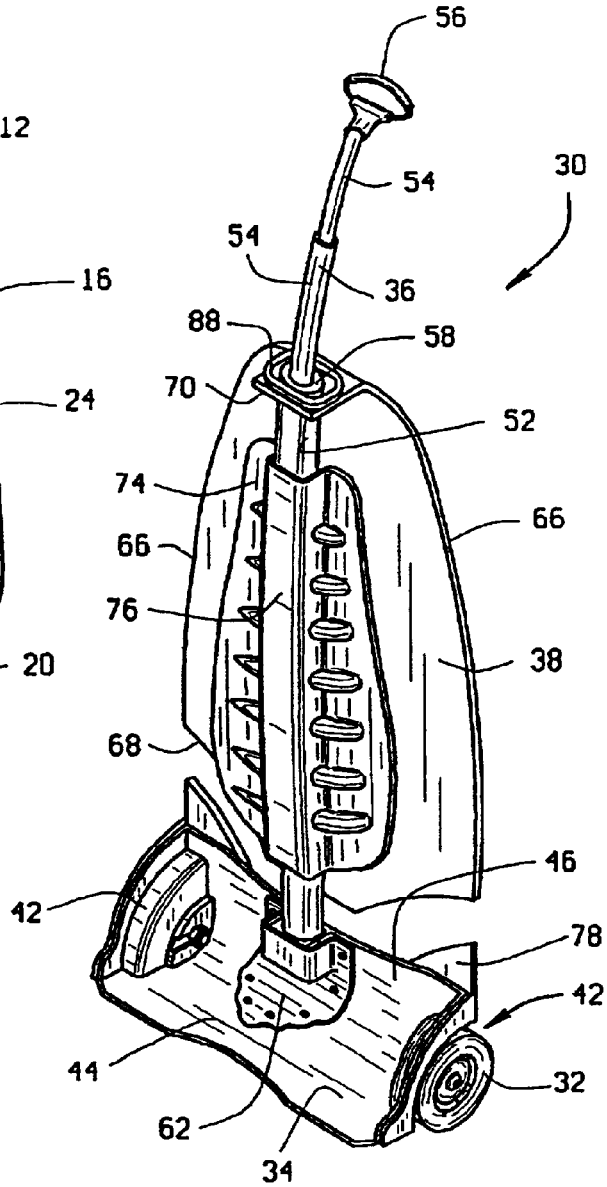
FIG. 3 is an assembly view of the structural components of the preferred embodiment of the invention shown without the flexible outer pack portion of the backpack.
Figure 2:
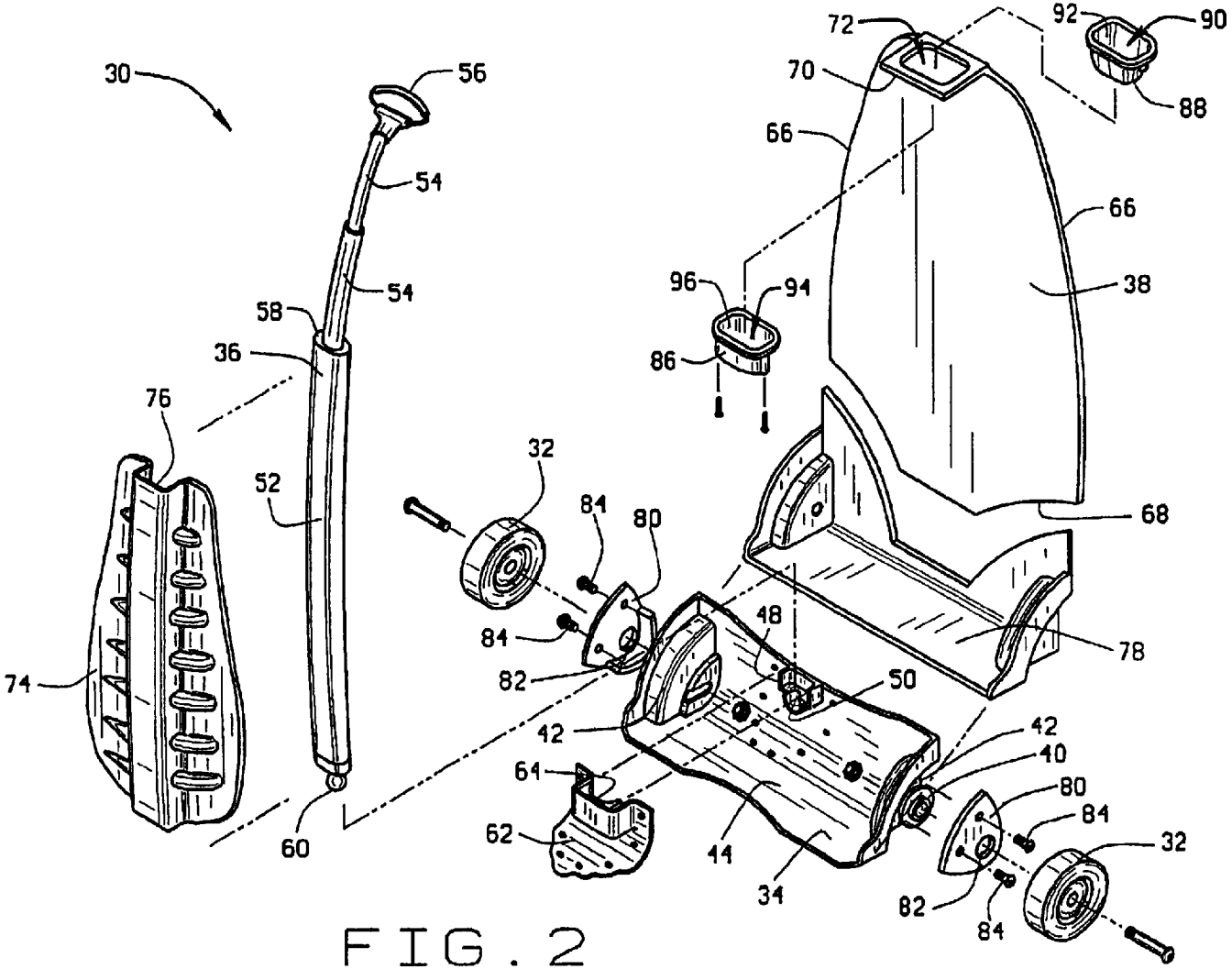
FIG. 2 is an exploded assembly view of the structural components of the preferred embodiment of the invention.

The towing system 30 of the preferred embodiment of the wheeled-backpack 10 is largely concealed within the pack portion 12. For purposes of describing the invention, the various components of the towing system 30 are shown without the pack portion 12 in FIGS. 2 and 3. FIG. 2 shows the components in an exploded isometric view and FIG. 3 shows the components in an isometric assembly view. In general, the towing system 30 of the wheeled-backpack 10 comprises a pair of wheels 32 mounted to a rigid base 34, an extendable towing member 36, and a backing sheet 38.

In the wheeled-backpack 10 of the preferred embodiment, the wheels 32 of the towing system 30 are made of plastic and are pivotally attached to the rigid base 34 on a pair of axially aligned wheel mounts 40 formed within wheel wells 42 on opposite sides of the rigid base. The rigid base 34 is preferably formed as a single monolithic piece of polymeric or acetate resin. The base 34 has a bottom portion 44 which is reinforced by a generally vertical portion 46 and the pair of wheel wells 42 that provide suitable stiffness for supporting the weight of the items stowed in the storage compartment 26 of the pack portion 12 and hold the wheels 32 in alignment when the wheeled-backpack 10 is being towed. A protrusion 48 from the vertical portion 46 of the rigid base 34 is positioned centrally between the wheel wells 42. The protrusion 48 has a semi-spherical indentation 50 that forms one half of a socket portion of a ball-and-socket joint used to connect the rigid base to the towing member 36 as discussed below.

The extendable towing member 36 of the wheeled-backpack 10 is a single-pole curved telescoping member comprised of a tubular non-extendable portion 52 and preferably two tubular extendable portions 54. The non-extendable portion 52 and the extendable portions 54 of the towing member 36 are preferably made of metal to provide adequate strength and wear properties to the towing member. The non-extendable portion 52 and extendable portions 54 are slidably engaged with one another in a telescoping manner to extend and retract a tow handle 56 from the wheeled-backpack 10. The non-extendable portion 52 of the towing member 36 has an oval cross-section and is arched along its length to partially conform to the curvature of a person's back. The extendable portions 54 of the towing member 36 have a similar cross-section to that of the non-extendable portion 52 and are also curved such that the extendable portions of the towing member can be selectively retracted within the non-extendable portion of the towing member or, alternately, extended partially outward from the top end 58 of the non-extendable portion as desired. The curvature of the towing member 36 allows the tow handle 56, which is attached to a free end of one of the extendable portions 54 of the towing member, to be extended upwardly and forwardly of the wheeled-backpack 10 along a curved path until reaching a fully extended position as shown in FIG. 1. The oval cross-section of the non-extendable and extendable portions 52, 54 of the towing member 36, in addition to the curvature thereof, prevents the extendable portions from twisting relative to each other as well as relative to the non-extendable portion of the towing member.

A ball fitting 60, preferably made of plastic, is attached to the bottom end of the non-extendable portion 52 of the towing member 36. The ball fitting 60 has a spherical exterior dimensioned slightly smaller than the semi-spherical indentation 50 formed in the protrusion 48 of the rigid base 34. During assembly of the towing system 30, the ball fitting 60 is positioned against the semi-spherical indentation 50 of the rigid base 34 and a separate retaining member 62 is then attached to the rigid base for securing the towing member 36 to the rigid base. The retaining member 62 has a semi-spherical indentation 64 that, combined with the semi-spherical indentation 50 of rigid base 34, forms the socket portion of the ball-and-socket joint which connects the towing member to the base and allows the towing member 36 to pivot and twist relative to the rigid base.

The backing sheet 38 used in the preferred embodiment of the wheeled-backpack 10 is a thin sheet of high density foam or other similar resiliently flexible material. The backing sheet 38 is positioned inside the pack portion 12 between the non-extendable portion 52 of the towing member 36 and the front 14 of the pack portion where it functions as a cushion and prevents a wearer of the backpack from feeling the towing member against his or her back. The backing sheet 38 is preferably sewn to the front 14 of the pack portion 12 along opposite edges 66 of the backing sheet, while the bottom edge 68 of the backing sheet is preferably left unattached. Additionally, a top portion 70 of the backing sheet is angled relative to the remainder of the backing sheet and lays adjacent the top 18 of the pack portion 12. The backing sheet top portion 70 has an opening 72 configured to allow passage of the towing member 36 therethrough as is discussed below.

A channel member 74, preferably made of material identical to that of the backing sheet 38, is used to attach the backing sheet to the towing member 36 by forming a sleeve around the non-extendable portion 52 of the towing member. The channel member 74 is preferable sewn along its perimeter to the backing sheet 38. The channel member 74 is formed with a channel portion 76 that is only slightly larger in cross-section than is the non-extendable portion 52 of the towing member 36. When attached to the backing sheet 38, the channel member holds the backing sheet against the curvature of the towing member to provide the backing sheet with a similar curvature. This configuration allows the backing sheet 38 to twist and slide vertically relative to the towing member 36, within the limitations of the pack portion 12 and the connection of the top 70 of the backing sheet 38 to the towing member 36.

In addition to the main components of the towing system 30 described above, the preferred embodiment of the wheeled-backpack 10 utilizes several other components to attach the towing system to the pack portion 12. One such component is a lower sheet 78 that is preferably made of material identical to that of the backing sheet 38. The lower sheet 78 is molded to generally conform to the shape of the rigid base 34 of the towing system 30. The lower sheet 78 is sewn to the inside of the pack portion 12 adjacent the bottom 20 of the pack portion where it separates the rigid base 34 from the pack portion. In this position, the lower sheet 78 provides a cushion between the rigid base 34 of the towing system 30 and a wearer's back when the wheeled-backpack 10 is being worn and also prevents the pack portion 12 of the wheeled-backpack from abrading against the rigid base.

The backpack also comprises a pair of identical hub plates 80 that are preferably made of material identical to that of the rigid base 34. The hub plates 80 each have an opening 82 dimensioned to allow passage of the wheel mounts 40 of the rigid base 34 therethrough. The hub plates are attached by threaded fasteners 84 to the wheel wells 42 of the rigid base 34 from the exterior of the pack portion 12. Thus, the hub plates 80 and the rigid base 34 "sandwich" the pack portion 12 and lower sheet 78 therebetween to attach the rigid base to the pack portion while avoiding creating any areas on the material of the pack that would wear quickly due to their attachment to the base. Additionally, the hub plates 80 also act to hold the bottom 20 and sides 22, 24 of the pack portion 12 tight against the wheel wells 42 to prevent the pack portion from interfering with the rotation of the wheels 32.

Interior 86 and exterior 88 sleeves further secure the towing member 36 to the pack portion 12. The exterior sleeve 88 has an opening 90 for passage of the towing member 36 therethrough and a cup shaped portion 92 configured to receive the tow handle 56 therein when the towing member is in the retracted position. The interior socket 86 also has an opening 94 for passage of the towing member 36 therethrough and a cup portion 96 configured to receive the cup shaped portion 92 of the exterior sleeve 88. The interior and exterior sleeves 86, 88 are secured to each other by threaded fasteners with the pack portion 12 and the top 70 of the backing sheet 36 "sandwiched" therebetween and with the top end 58 of the non-extendable portion 52 of the towing member 36 positioned in the openings of each sleeve. Thus, like the hub plates 80, the interior and exterior sleeves 86, 88 are configured to connect the top 18 of the pack portion 12 to the towing member 36 without creating any areas on the material of the pack that could potentially wear quickly due to their attachment to the sleeves.

Once assembled as described above, the preferred embodiment of the wheel-backpack 10 can be worn by a person like a standard non-wheeled-backpack by opening the closeable shroud 28 and using the shoulder straps and waist strap therebehind. When so doing, the towing member 36 can be retracted with the tow handle 56 neatly positioned out of the way in the cup shaped 92 portion of the exterior sleeve 88 at the top 18 of the pack portion 12. Additionally, in this configuration, the closeable shroud 28 can be tucked away into a pocket (not shown) at the base of the front 14 of the pack portion 12.

When being worn as described above, the configuration of the ball-and-socket joint between the rigid base 34 and the towing member 36 of the wheeled-backpack 10 allows the towing member to pivot in multiple planes relative to the rigid base, including rotation about a vertical axis. As a wearer walks or runs, the pivotal connection allows the rigid base 34 to tilt from side to side and to twist relative to the towing member 36 and the backing sheet 38 such that the rigid base is able to move with the wearer's hips without causing the rest of the wheeled-backpack 10 to shift back and forth. Additionally, because the backing sheet 38 is free to rotate about the towing member 36 and because the towing member is free to pivot relative to the base 34, the upper portion of the wheeled-backpack 10 can twist relative to lower portion of the wheeled-backpack so as to maintain maximum contact against the person's back, thereby increasing the comfort of wearing the wheeled-backpack.

When desired, the wheeled-backpack 10 can be removed from the wearer's back and towed along the ground by concealing the straps behind the closeable shroud 28 and extending the towing handle 56 from the cup shaped portion 92 of the exterior socket 88 as shown in FIG. 1. In this configuration, the front 14 of the pack portion 12 is tilted toward the ground with the wheeled-backpack 10 being supported above the ground by the wheels 32. The position of the tow handle 56 provided by the curved telescoping members 52, 54 allows a person to tow the wheeled-backpack behind his or her self without risk of the wheeled-backpack 10 interfering with the person's legs as he or she walks. Additionally, the curvature of the towing member 36 also keeps the wheeled-backpack 10 more upright than would a towing member that extends straight upwards from the piece of baggage, resulting in a more preferable weight distribution toward the wheels 32 and away from the tow handle 56. Furthermore, the pivotal connection between the towing member 36 and the rigid base 34 reduces the bending moment that would otherwise be induced in a rigid non-pivotal joint between conventional towing member and rigid base as the wheeled-backpack 10 is rolled over obstructions. Finally, the "towability" of the wheeled-backpack 10 is improved over prior art wheeled-backpacks because the wheels 32 are allowed to "step over" obstructions independently without also tilting the entire pack portion 12 and because the wheeled-backpack is less likely to tip-over as side forces are applied to the tow handle 56 when towing the wheeled-backpack around a corner.

It should be understood that in the wheeled-backpack 10 of the preferred embodiment, the pivotal movement of the towing member 36 relative to rigid base 34 is ultimately limited by the configuration of the ball-and-socket joint and it should be apparent that at certain angles of pivot, the non-extendable portion 52 of the towing member 36 would engage the rigid base 34 or the retaining member 62 of the joint which would prevent further movement in a given direction. However, the wheeled-backpack 10 of the preferred embodiment is configured such that the pack portion 12 also acts to limit the permissible movement of the towing member 36 relative to the rigid base 34 by merely becoming taut and thereby carries most of the bending loads that must ultimately pass from the towing member to the rigid base.

It should also be understood that, although the invention has been described above in reference to a specific embodiment, the invention is not limited to this embodiment and numerous alternative embodiments or changes to the preferred embodiment could be made as would be apparent to one of ordinary skill in the art without departing from the scope of the invention. For example, the connection between the non-extendable portion of the towing member and the rigid base could be a pin joint or even a rivet that allows the towing member to pivot in only one plane relative to the rigid base portion. In another alternative embodiment, the towing member could simply be attached to the baggage without directly engaging a base portion. In such a configuration, the backpack itself would act as a pivotal connection. In yet another alternative embodiment, the rigid base portion could have a completely different shape or even be eliminated altogether while still allowing the towing member to pivot relative to the wheels. Yet another embodiment could utilize more than a single telescoping member and such towing members need not be curved nor telescoping.

Thus it should be clear that modifications and variations could be made without departing from the scope of the invention which should be considered as being limited only by the scope of the following claims and their legal equivalents.

What is claimed:

1. A piece of baggage designed to be pulled behind a person comprising:

a pack portion having a front and a base;

at least two wheels positioned toward said front and toward said base of said pack portion; and a curved and rigid towing member having a first and a second end and a length therebetween, said towing member comprising at least two portions that are slideably engaged in a manner to allow said at least two portions to move relative to one another in a telescoping manner between a retracted and extended position, wherein said length of said towing member is arcuate, wherein said first end of said towing member is forward of said front of said pack portion, and is not positioned over said base, when said piece of baggage is placed on said base and said towing member is in said extended position, wherein said towing member comprises a single-pole telescoping member wherein the single-pole telescoping member has an oval cross-section.

2. A piece of baggage designed to be pulled behind a person comprising:

a pack portion having a front and a base;

at least two wheels positioned toward said front and toward said base of said pack portion; and a curved and rigid towing member having a first and a second end and a length therebetween, said towing member comprising at least two portions that are slideably engaged in a manner to allow said at least two portions to move relative to one another in a telescoping manner between a retracted and extended position, wherein said length of said towing member is arcuate, wherein said first end of said towing member is forward of said front of said pack portion, and is not positioned over said base, when said piece of baggage is placed on said base and said towing member is in said extended position, wherein said piece of baggage is a backpack designed to be worn on a person's back.

3. A piece of baggage designed to be pulled behind a person comprising:

a pack portion having a front and a base;

at least two wheels positioned toward said front and toward said base of said pack portion; and a curved and rigid towing member having a first and a second end and a length therebetween, said towing member comprising at least two portions that are slideably engaged in a manner to allow said at least two portions to move relative to one another in a telescoping manner between a retracted and extended position, wherein said length of said towing member is arcuate, wherein said first end of said towing member is forward of said front of said pack portion, and is not positioned over said base, when said piece of baggage is placed on said base and said towing member is in said extended position, wherein said piece of baggage is a backpack designed to be worn on a person's back, wherein a portion of said backpack may be concealed behind a shroud on said front of said pack portion.

* * * * *